US007080833B2

(12) United States Patent
Mitsuhashi

(10) Patent No.: US 7,080,833 B2
(45) Date of Patent: Jul. 25, 2006

(54) PAPER FEEDING APPARATUS

(75) Inventor: Masaaki Mitsuhashi, Daito (JP)

(73) Assignee: Funai Electric Co., Ltd., Daito (JP)

( * ) Notice: Subject to any disclaimer, the term of this patent is extended or adjusted under 35 U.S.C. 154(b) by 0 days.

(21) Appl. No.: 10/882,245

(22) Filed: Jul. 2, 2004

(65) Prior Publication Data

US 2005/0017432 A1 Jan. 27, 2005

(51) Int. Cl.
*B65H 1/00* (2006.01)

(52) U.S. Cl. ..... 271/162; 271/117; 271/145

(58) Field of Classification Search ..... 271/117, 271/162, 145, 109; 347/104
See application file for complete search history.

(56) References Cited

U.S. PATENT DOCUMENTS 6,352,256 B1 * 3/2002 Hsieh ..... 271/110
2004/0207145 A1 * 10/2004 Chang ..... 271/117
2005/0001371 A1 * 1/2005 Otsuki ..... 271/113
2005/0062217 A1 * 3/2005 Asada ..... 271/162

FOREIGN PATENT DOCUMENTS

JP 08-239126 9/1996

* cited by examiner

*Primary Examiner*—Eileen D. Lillis
*Assistant Examiner*—Kaitlin Joerger
(74) *Attorney, Agent, or Firm*—Crowell & Moring LLP

(57) ABSTRACT

A sheet base, a base portion and a paper feeding roller unit are provided. A fixed inclined portion of the sheet base is raised from the base portion. A movable portion of the sheet base is provided with an arm attached to a later shaft. The arm is attached with a shaft member of the paper feeding roller unit. When an attitude of the movable portion is changed from an erected attitude to a fallen attitude, the paper feeding roller unit is moved down. When the attitude of the movable portion is changed from the fallen attitude to the erected attitude, the paper feeding roller unit is moved up. A drive gear is attached to the lateral shaft and a driven gear for transmitting rotation of the drive gear to an input ring member is attached to the shaft member.

6 Claims, 4 Drawing Sheets

PAPER FEEDING APPARATUS

BACKGROUND OF THE INVENTION

1. Field of the Invention

The prevent invention relates to a paper feeding apparatus used as a paper feeding mechanism of a printing apparatus or an image forming apparatus, further in details, relates to a paper feeding apparatus for feeding sheet mounted on a sheet base to a printing region or the like of a printing apparatus by rotating a paper feeding roller.

2. Description of the Related Art

FIG. 4 is an outline vertical sectional view showing an essential portion of a paper feeding apparatus according to a prior art example. The paper feeding apparatus includes a sheet base 1 mounted with sheet S, a base portion 2 for supporting a sheet end S1 of the sheet 1 mounted on the sheet base 1, and a paper feeding roller unit 3. The sheet base 1 is divided into a fixed inclined portion 11 and a movable portion 12, and whereas the fixed inclined portion 11 is inclinedly raised from the base portion 2, the movable portion 12 is erectable and fallable centering on a lateral shaft 13 arranged at a constant position by being supported by a side plate portion 21 arranged at a side portion of the base portion 2. Further, when the movable portion 12 is brought into a fallen attitude as shown by a bold line of the drawing by being folded as shown by an arrow mark a, the movable portion 12 covers the paper feeding roller unit 3 from above and when the movable portion 12 is brought into an erected attitude as shown by an imaginary line of the drawing by being developed as shown by an arrow mark b, the movable portion 12 is extended to an upper side of the fixed inclined portion 11 to support a portion of the sheet S mounted on the fixed inclined portion 11 projected from the fixed inclined portion 11. Further, the paper feeding roller unit 3 include a paper feeding roller 32 and a rotation transmitting mechanism 33 cooperatively connected with the paper feeding roller 32 in a case 31 having a prolonged vertical length and the rotation transmitting mechanism 33 is formed by a gear train having an input ring member 34 including a gear arranged upward from the paper feeding roller 32. Further, a shaft member 35 as a rotating shaft of the input ring member 34 is supported by the side plate portion 21 to project to an outer side therefrom and the outer side of the side plate portion 21 is attached with a driven gear 36 rotated by being brought in mesh with a drive gear (not illustrated) rotated by being transmitted with rotation of a motor.

According to the paper feeding apparatus having the constitution, the sheet end S of the sheet S mounted on the fixed inclined portion 11 is supported by the base portion 2. Further, when the paper feeding roller 32 of the paper feeding roller unit 3 is brought into contact with the sheet S to rotate, the sheet S is fed to slide on the base portion 2 by the rotation. In the paper feeding apparatus, a position at which the paper feeding roller 32 is brought into contact with the sheet S in feeding paper, that is, a position of operating the paper feeding roller 32 is determined to a predetermined position upward from the base portion 2 and a friction face 14 is formed on a side of the fixed inclined portion 11 in correspondence with the position. The friction face 14 serves to prevent overlappingly feed sheet such that when the sheet S is laminated on the fixed inclined portion 11, lowermost side sheet follows the sheet S fed by the paper feeding roller 32 to feed.

As described above, according to the paper feeding apparatus of the prior art, the position of operating the paper feeding roller 32 is determined at the predetermined position upward from the base portion 2, further, a height of installing the paper feeding roller unit 3 having the paper feeding roller 32 is determined to be constant by a height of installing the shaft member 35 supported by the side plate portion 21. Therefore, a position of a height of the movable portion 12 in constituting the fallen attitude of folding the movable portion 12 and covering the paper feeding roller unit 3 is restricted by the height of installing the paper feeding roller unit 3.

There is known other prior art example in which in a paper feeding apparatus of an image forming apparatus, a sheet laminating plate (in correspondence with the above-described movable sheet base) is attached with a sheet end supporting portion (in correspondence with the above-described base portion) for supporting a sheet end of sheet and a paper feeding roller (in correspondence with the above-described sheet feeding roller) to thereby unitize the sheet laminating plate, the sheet end supporting portion and the paper feeding roller (refer to, for example, JP-A-8-239126). According to the paper feeding apparatus, the sheet laminating plate is made to be erectable and fallable centering on a rotational axis line of a feed roller for carrying sheet to a printing portion, when the sheet laminating plate is erected to contain at a back portion of an apparatus main body, the paper feeding roller is also contained in the apparatus main body and when the sheet laminating plate is fallen to a back side of the apparatus main body to project to the back portion, also the paper feeding roller is projected to a side portion of the apparatus main body to thereby enable to feed sheet mounted on the sheet laminating plate. By adopting the constitution, the image forming apparatus can be downsized, particularly, a size of the apparatus main body in a front and rear direction can be shortened.

According to the paper feeding apparatus of the prior art explained in reference to FIG. 4, the position of operating the paper feeding roller 32 is determined to the predetermined position upward from the base portion 2, the height of installing the paper feeding roller unit 3 is determined to be constant and therefore, as described above, the position of the height of the movable portion 12 in constituting the fallen attitude of folding the movable portion 12 of the sheet base land covering the paper feeding roller unit 3 is restricted by the height of installing the roller unit 3. Therefore, there poses a problem that it is restricted by a structure of attaching the paper feeding roller unit 3 to downsize the apparatus by restraining a total height H2 of the paper feeding apparatus in bringing the movable portion 12 into the fallen attitude to be low.

Meanwhile, according to the prior art example described in JP-A-8-239126, the paper feeding roller for feeding sheet mounted to the sheet laminating plate is unitized integrally with the sheet laminating plate and therefore, the position of the sheet laminating plate in erecting the sheet laminating plate to contain to the apparatus main body is not restricted by the paper feeding roller and the apparatus can be downsized by restraining the size of the apparatus main body in the front and rear direction to be short. However, according to the paper feeding apparatus described in JP-A-8-239126, also the sheet end supporting portion for supporting the sheet end of sheet mounted on the sheet laminating plate is integrated to the sheet laminating plate along with the paper feeding roller and therefore, when the sheet laminating plate is erected or fallen, also a member for supporting the sheet end of sheet is erected or fallen along with the paper feeding roller and a positional relationship among three members of the sheet laminating plate, the paper feeding roller and the sheet end is always maintained constant.

In contrast thereto, according to the prior art example explained in reference to FIG. 4, the sheet base 1 is divided into the fixed inclined portion 11 and the movable portion 12, the fixed inclined portion 11 is raised integrally from the base portion 2 and therefore, the sheet base 1, the base portion 2 and the paper feeding roller unit 3 cannot be integrated by applying the technology described in JP-A-8-239126.

SUMMARY OF THE INVENTION

It is an object of the invention to provide a paper feeding apparatus capable of being downsized by restraining a total height of the apparatus in bringing the above-described movable portion of the sheet base divided into the fixed inclined potion and the movable portion into the fallen attitude to be low.

Further, it is an object of the invention to provide a paper feeding apparatus capable of being downsized by restraining the total height of the apparatus in bringing the movable portion into the fallen attitude to be low by only devising a position of a lateral shaft supporting the movable portion of the sheet base and a structure of attaching paper feeding roller unit 3.

Further, it is an object of the invention to downsize a paper feeding apparatus in which particularly the sheet feeding roller is provided at a lower portion of the paper feeding roller unit having a prolonged vertical length.

According to the invention, there is provided a paper feeding apparatus including a sheet base mounted with a sheet, a base portion for supporting a sheet end of the sheet mounted on the sheet base, and a paper feeding roller unit having a paper feeding roller for being brought into contact with the sheet mounted on the sheet base at an operating position upward from the base portion to rotate to thereby exert a force of feeding the sheet and a rotation transmitting mechanism cooperatively connected to the paper feeding roller, wherein the sheet base is divided into a fixed inclined portion inclinedly raised from the base portion, and a movable portion erected and fallen between a fallen attitude covering the paper feeding roller unit from an upper side thereof and an erected attitude extended to an upper side of the fixed inclined portion for supporting a portion of the sheet mounted on the fixed inclined portion projected from the fixed inclined portion, the movable portion is erectably and fallably supported by a lateral shaft arranged at a constant position, further, the rotation transmitting mechanism of the paper feeding roller unit includes an input ring member arranged upward from the paper feeding roller, and a position of operating the paper feeding roller is determined at a position opposed to the fixed inclined portion.

Further, an upper end portion of the paper feeding roller unit is pivotally attached to the movable portion of the sheet base, and the paper feeding roller unit is moved down by operating to change an attitude of the movable portion from the erected attitude to the fallen attitude to move the paper feeding roller from the operating position to a containing position downward from the operating position and the paper feeding roller unit is moved up by operating to change the attitude of the movable portion from the fallen attitude to the erected attitude to thereby move the paper feeding roller from the containing position to the operating position.

According to the constitution, when the movable portion of the sheet base is operated to fall from the erected attitude, the paper feeding roller unit is moved down to move the paper feeding roller to the containing position downward from the operating position and therefore, operation of falling the movable portion is not restricted by the structure of attaching the paper feeding roller unit 3, a total height of the apparatus when the movable portion is brought into the fallen attitude becomes low and the paper feeding apparatus is downsized by that amount. Further, when the movable position of the sheet base is operated to erect from the fallen attitude, the paper feeding roller unit is moved up to move the paper feeding roller to the operating position upward from the containing position and therefore, in a state of bringing the movable portion to the erected attitude, paper can be fed normally by the paper feeding roller.

According to the invention, it is preferable that at the containing position of the paper feeding roller, the paper feeding roller rides over the base portion. When constituted in this way, a width of lowering the paper feeding roller unit when the attitude of the movable portion is changed from the erected attitude to the fallen attitude can be ensured to be larger than an interval between the operating position of the paper feeding roller and the base portion and therefore, the total height of the apparatus when the movable portion is brought into the fallen attitude can easily be lowered.

According to the invention, it is preferable that the paper feeding roller unit is attached pivotally to the movable portion of the sheet base at a position concentric with a rotational center of the input ring member, in that case, there can be adopted a constitution in which the movable portion is made to be erectable and fallable by providing an arm pivotally supported by the lateral shaft to the movable portion of the sheet base and the paper feeding roller unit is pivotally attached to the arm at an eccentric portion relative to an axis line of the lateral shaft. According thereto, the arm can be formed integrally with the movable portion of the sheet base and therefore, the paper feeding apparatus can be downsized without increasing a number of parts.

According to the invention, there can be also adopted a constitution in which the input ring member is rotatably supported by a shaft member provided to the paper feeding roller unit and the shaft member is extended in a side direction of the roller unit to be attached to the arm to thereby pivotally attach the paper feeding roller unit to the arm and the shaft member is displaced in an up and down direction around the lateral shaft along with an operation of erecting and falling the movable portion of the sheet base.

The paper feeding apparatus according to the invention is further specified by adopting the following constitution. That is, the invention is further specified by adopting a constitution of a paper feeding apparatus including a sheet base mounted with a sheet, a base portion for supporting a sheet end of the sheet mounted on the sheet base, and a paper feeding roller unit having a paper feeding roller for being brought into contact with the sheet mounted on the sheet base at an operating position upward from the base portion to rotate to thereby exert a force of feeding the sheet and a rotation transmitting mechanism cooperatively connected to the paper feeding roller, wherein the sheet base is divided into a fixed inclined portion inclinedly raised from the base portion, and a movable portion erected and fallen between a fallen attitude covering the paper feeding roller unit from an upper side thereof and an erected attitude extended to an upper side of the fixed inclined portion for supporting a portion of the sheet mounted on the fixed inclined portion projected from the fixed inclined portion, the movable portion is erectably and fallably supported by a lateral shaft arranged at a constant position, further, the rotation transmitting mechanism of the paper feeding roller unit includes an input ring member arranged upward from the paper feeding roller, and a position of operating the paper feeding roller is determined at a position opposed to the fixed inclined portion, the movable portion is made to be erectable and fallable by providing an arm pivotally supported by the lateral shaft to the movable portion of the sheet base, the input ring member is rotatably supported by a shaft member provided to the paper feeding roller unit, the shaft member is extended in a side direction of the paper feeding roller unit and pivotally attached to the arm at an eccentric portion relative to an axis line of the lateral shaft to thereby displace the shaft member in an up and down direction around the lateral shaft by operating to erect and fall the movable portion, the paper feeding roller unit is moved down by operating to change an attitude of the movable portion from the erected attitude to the fallen attitude and the paper feeding roller is moved from the operating position to a containing position at which the paper feeding roller rides over the base portion and by operating to change the attitude of the movable portion from the fallen attitude to the erected attitude, the paper feeding roller unit is moved up and the paper feeding roller is moved from the containing position to the operating position, and the lateral shaft is attached with a drive gear driven to rotate by a motor and the shaft member is attached with a driven gear for transmitting rotation of the drive gear to the input ring member by being brought in mesh with the drive gear when the movable sheet base is brought into the erected attitude. According to the constitution, power is transmitted to the paper feeding roller unit via the drive gear attached to the lateral shaft and the driven gear attached to the shaft member. The operation of the invention will be described further in details in reference to an embodiment explained below.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1:
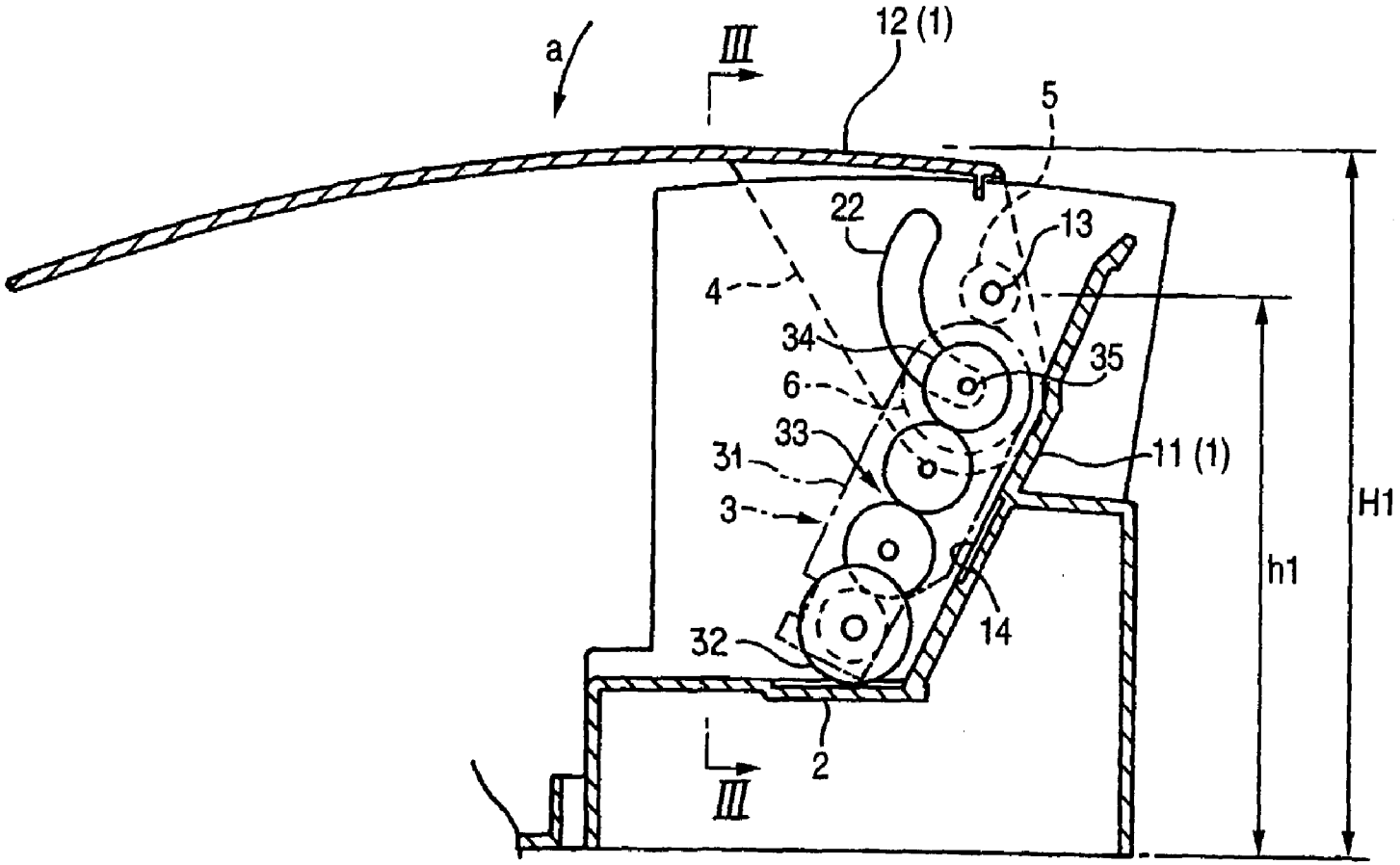
FIG. 1 is an outline vertical sectional view of an essential portion of a paper feeding apparatus according to an embodiment of the invention in a state in which a movable portion of a sheet base is brought into a fallen attitude.
Figure 2:
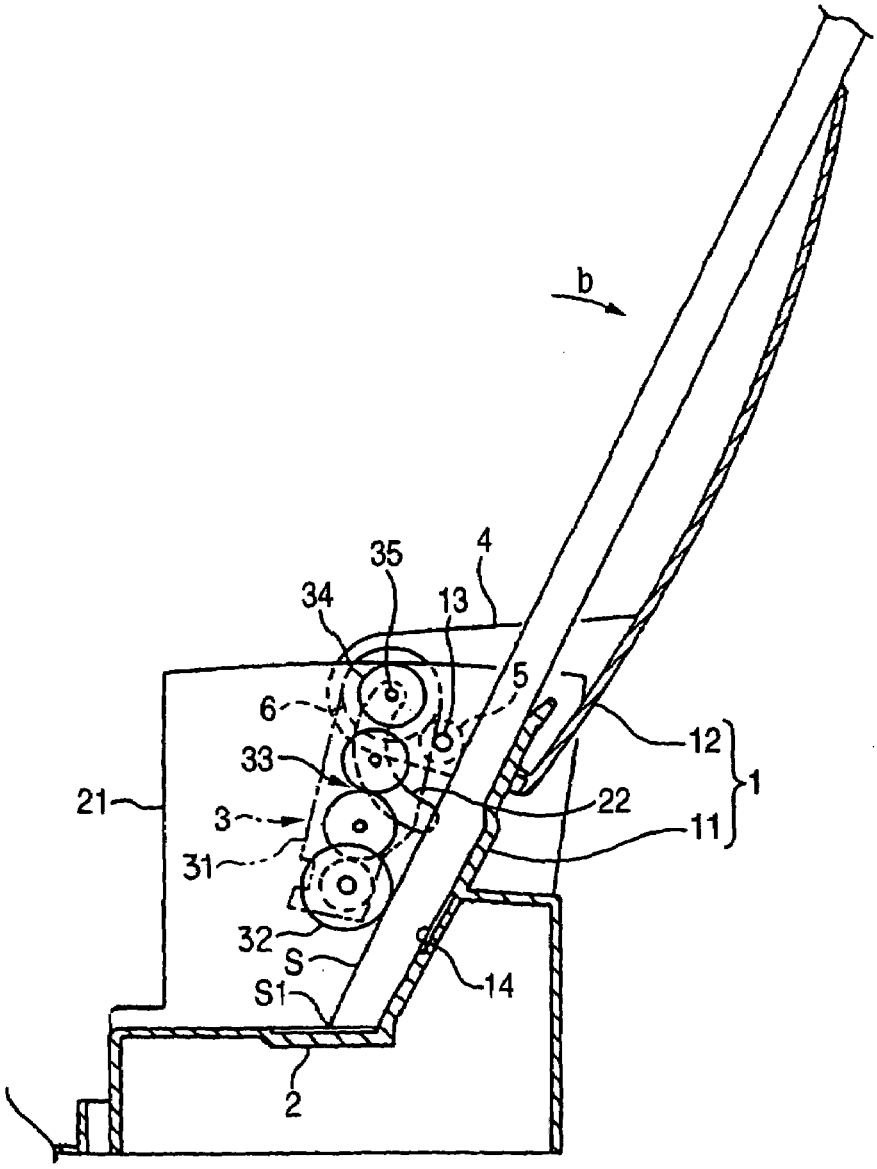
FIG. 2 is an outline sectional view of an essential portion of the paper feeding apparatus in a state in which the movable portion of the sheet base is brought into an erected attitude.
Figure 3:
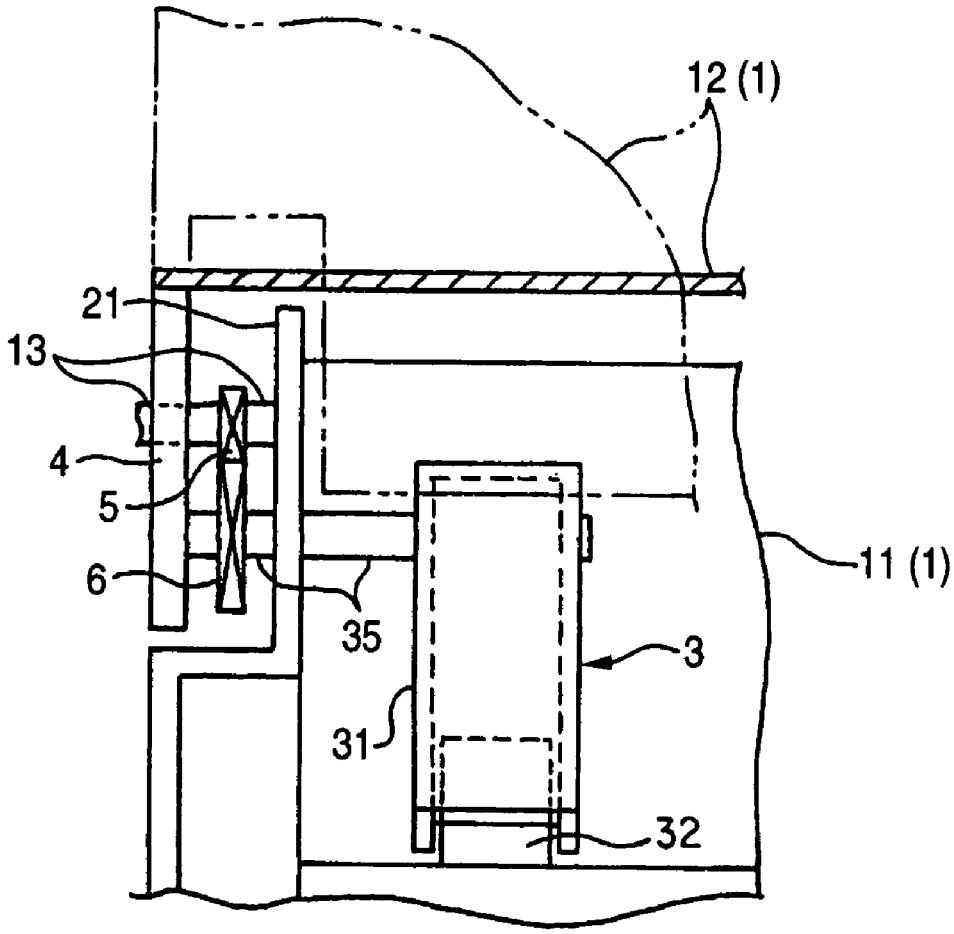
FIG. 3 is an outline sectional view of a portion taken along a line III—III of FIG. 1.

FIG. 1 is an outline vertical sectional view of an essential portion of a paper feeding apparatus according to an embodiment of the invention in a state in which the movable portion 12 of the sheet base 1 is brought into the fallen attitude. FIG. 2 is an outline sectional view of an essential portion of the paper feeding apparatus in a state in which the movable portion 12 of the sheet base 1 is brought into the erected state, FIG. 3 is an outline sectional view of a portion taken along a line III—III of FIG. 1.

Figure 4:
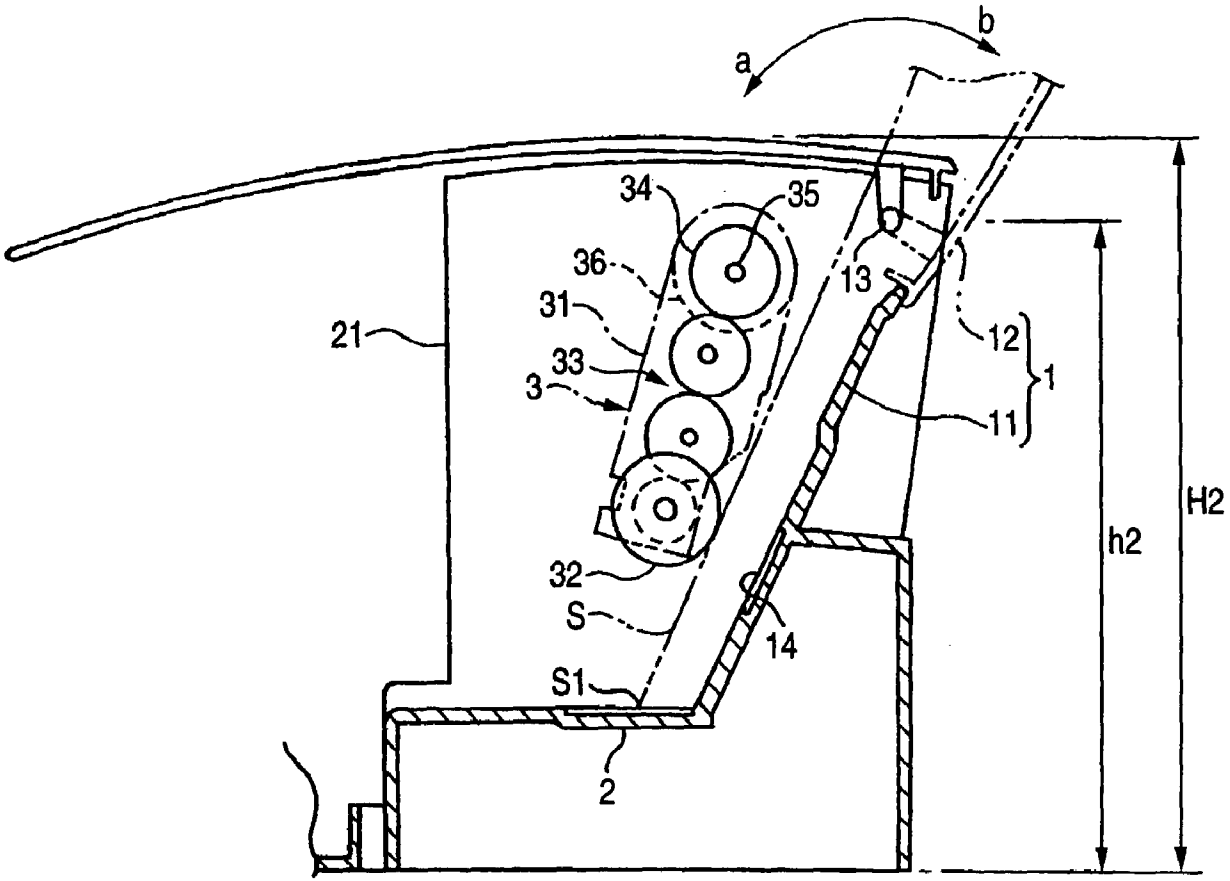
FIG. 4 PRIOR ART
FIG. 4 is an outline vertical sectional view of an essential portion of a paper feeding apparatus of a prior art.

The paper feeding apparatus of the embodiment includes the sheet base 1 mounted with the sheet S, the base portion 2 for supporting the sheet end S1 of the sheet S mounted on the sheet base 1, and the paper feeding roller unit 3 similar to the prior art example explained in reference to FIG. 4. Further, the sheet base is divided into the fixed inclined portion 11 and the movable portion 12, whereas the fixed inclined portion 11 is inclinedly raised from the base portion 2, the movable portion 12 is erectable and fallable centering on the lateral shaft 13 arranged at the constant position by being supported by the side plate portion 21 arranged at the side portion of the base portion 2, when the movable portion 12 is brought into the fallen attitude by being folded as shown by the arrow mark a of FIG. 1, the movable portion 12 covers the paper feeding roller unit 3 from above and when the movable portion 12 is developed as shown by the arrow mark b of FIG. 2 and brought into the erected attitude as shown by the imaginary line of the drawing, the movable portion 12 is extended to the upper side of the fixed inclined portion 11 to support the portion of the sheet S mounted on the fixed inclined portion 11 projected from the fixed inclined portion 11 similar thereto. Further, the paper feeding roller unit 3 includes the paper feeding roller 32 and the rotation transmission mechanism 33 cooperatively connected to the paper feeding roller 32 in the case 31 having the prolonged vertical length and the rotation transmitting mechanism 33 is formed by the gear train having the input ring member 34 including the gear arranged upward from the paper feeding roller 32 similar thereto.

According to the embodiment, the position of the height of the lateral shaft 13 and the structure of attaching the paper feeding roller unit 3 differ from those of the prior art example of FIG. 4.

That is, a height h1 of installing the lateral shaft 13 supported by the side plate portion 21 becomes lower than an installing height h1 of the prior art example of FIG. 4. Further, as shown by FIG. 4, the movable portion 12 is made to be erectable and fallable by providing an arm 4 pivotally supported by the lateral shaft 13 at a base portion of the movable portion 12. The arm 4 is integrally molded with the movable portion 12 including a synthetic resin molded member. In contrast thereto, according to the paper feeding roller unit 3, a shaft member 35 as a rotating shaft for supporting the input ring member 34 is pivotally attached to the arm 4 at an eccentric portion on a front side relative to an axis line of the lateral shaft 13 by being extended in a side direction of the case 31 of the paper feeding roller unit 3 as shown by FIG. 3. That is, the paper feeding roller unit 3 is pivotally attached to the movable portion 12 at a position concentric with a rotational center of the input ring member 34. By the constitution, the shaft member 35 is displaced in an up and down direction between an upper side and a lower side of the lateral shaft 13 around the lateral shaft 13 via operation of erecting and falling the movable portion 12.

When constituted in this way, by operation of changing the attitude of the movable portion 12 from the erected attitude of FIG. 2 to the fallen attitude of FIG. 1, the paper feeding roller unit 3 is moved down and the paper feeding roller 31 is moved from an operating position of FIG. 2 to a containing position downward therefrom. Particularly, according to the embodiment, as the containing position of the paper feeding roller 31, there is selected a position at which the paper feeding roller 31 rides over the base portion 2 as shown by FIG. 1, further specifically, a position at which the paper feeding roller 31 rides over the base portion 2 and moved in a sheet feeding direction. Further, by the operation of changing the attitude of the movable portion 12 from the fallen attitude of FIG. 1 to the erected attitude of FIG. 2, the paper feeding roller unit 3 is moved up and the paper feeding roller 31 is moved from the containing position of FIG. 1 to the operating position of FIG. 2.

According to the constitution, operation of falling the movable portion 12 is not restricted by the structure of attaching the roller unit 3 and a total height H1 of the apparatus when the movable portion 12 is brought into the fallen attitude becomes lower than the total height H2 of the apparatus in the case of FIG. 4 and the paper feeding apparatus is downsized by that amount. Particularly, according to the embodiment, the position of containing the paper feeding roller 31 is determined at the position at which the paper feeding roller 31 rides over the base portion 2, further specifically, the position at which the paper feeding roller 31 rides over the base portion 2 and moved in the sheet feeding direction and therefore, even when a width of lowering the paper feeding roller unit 3 in changing the attitude of the movable portion 12 from the erected attitude to the fallen attitude is ensured to be larger than a vertical interval between the position of operating the paper feeding roller 31 and the base portion 2, the paper feeding roller 31 is moved in the sheet feeding direction of the base portion 2 and the attitude of the movable portion 12 from the erected attitude to the fallen attitude can be changed unforcibly.

Next, the lateral shaft 13 is attached with a drive gear 5 on an outer side of the side plate portion 21. The drive gear 5 is transmitted with rotation of a motor, not illustrated. In contrast thereto, the shaft member 35 is fixedly attached with a driven gear 6 on the outer side of the side plate portion 21 and when the movable portion 12 is brought into the erected attitude as shown by FIG. 2, the driven gear 6 is brought in mesh with the drive gear 5. Therefore, when the movable portion 12 is erected as shown by FIG. 2 and the motor is started in using the apparatus, the rotation is transmitted to the paper feeding roller 31 via the drive gear 5, the driven gear 6 and the gear train including the input ring member 34 and the paper feeding roller 31 is rotated at the operating position to feed the sheet S to slide on the base portion 2.

Further, according to the embodiment, by forming a slit 22 at the side plate portion 21 and inserting the shaft member 35 into the slit 22, the shaft member 35 is moved in the slit 22 in accordance with erecting and falling the movable portion 12.

The other item is similar to that in the prior art example explained in reference to FIG. 4 and therefore, the same portion is attached with the same notation.

As has been explained above, the invention downsizes the paper feeding apparatus by restraining the total height of the apparatus in bringing the movable portion into the fallen attitude to be low by constituting an object by the paper feeding apparatus in which the sheet base is divided into the fixed inclined portion and the movable portion and the fixed inclined portion is integrally raised from the base portion. Therefore, a height of packing the paper feeding apparatus of this kind can be restrained to be lower than that of the prior art and transportation cost can be reduced by that amount. Despite thereof, in using the apparatus, similar to the case of the prior art, the paper feeding roller is brought into contact with the sheet mounted on the sheet base at a proper operating position and therefore, the sheet is fed smoothly.

The invention achieves an advantage that although the paper feeding apparatus includes the paper feeding roller unit having the prolonged vertical length, the total height of the apparatus can be restrained to be low without being influenced by the structure of attaching the paper feeding roller unit.

What is claimed is:

1. A paper feeding apparatus comprising:

a sheet base mounted with a sheet;

a base portion for supporting a sheet end of the sheet mounted on the sheet base; and a paper feeding roller unit including:

a paper feeding roller for being brought into contact with the sheet mounted on the sheet base at an operating position upward from the base portion to rotate to thereby exert a force of feeding the sheet; and a rotation transmitting mechanism cooperatively connected to the paper feeding roller, wherein:

the sheet base is divided into a fixed inclined portion inclinedly raised from the base portion, and a movable portion erected and fallen between a fallen attitude covering the paper feeding roller unit from an upper side thereof and an erected attitude extended to an upper side of the fixed inclined portion for supporting a portion of the sheet mounted on the fixed inclined portion projected from the fixed inclined portion, the movable portion is erectably and fallably supported by a lateral shaft arranged at a constant position, further, the rotation transmitting mechanism of the paper feeding roller unit includes an input ring member arranged upward from the paper feeding roller, and a position of operating the paper feeding roller is determined at a position opposed to the fixed inclined portion;

the movable portion operates simultaneously with an arm pivotally supported by the lateral shaft, the input ring member is rotatably supported by a shaft member provided to the paper feeding roller unit, the shaft member is extended in a side direction of the paper feeding roller unit and pivotally attached to the arm at an eccentric portion relative to an axis line of the lateral shaft to thereby displace the shaft member in an up and down direction around the lateral shaft by operating to erect and fall the movable portion;

the paper feeding roller unit is moved down by operating to change an attitude of the movable portion from the erected attitude to the fallen attitude and the paper feeding roller is moved from the operating position to a containing position at which the paper feeding roller rides over the base portion and by operating to change the attitude of the movable portion from the fallen attitude to the erected attitude, the paper feeding roller unit is moved up and the paper feeding roller is moved from the containing position to the operating position; and the lateral shaft is attached with a drive gear driven to rotate by a motor and the shaft member is attached with a driven gear for transmitting rotation of the drive gear to the input ring member by being brought in mesh with the drive gear when the movable sheet base is brought into the erected attitude.

2. A paper feeding apparatus comprising:

a sheet base mounted with a sheet;

a base portion for supporting a sheet end of the sheet mounted on the sheet base; and a paper feeding roller unit including:

a paper feeding roller for being brought into contact with the sheet mounted on the sheet base at an operating position upward from the base portion to rotate to thereby exert a force of feeding the sheet; and a rotation transmitting mechanism cooperatively connected to the paper feeding roller, wherein the sheet base is divided into a fixed inclined portion inclinedly raised from the base portion, and a movable portion erected and fallen between a fallen attitude covering the paper feeding roller unit from an upper side thereof and an erected attitude extended to an upper side of the fixed inclined portion for supporting a portion of the sheet mounted on the fixed inclined portion projected from the fixed inclined portion, the movable portion is erectably and fallably supported by a lateral shaft arranged at a constant position, further, the rotation transmitting mechanism of the paper feeding roller unit includes an input ring member arranged upward from the paper feeding roller, and a position of operating the paper feeding roller is determined at a position opposed to the fixed inclined portion;

an upper end portion of the paper feeding roller unit is pivotally attached to the movable portion of the sheet base; and the paper feeding roller unit is moved down by operating to change an attitude of the movable portion from the erected attitude to the fallen attitude to move the paper feeding roller from the operating position to a containing position downward from the operating position and the paper feeding roller unit is moved up by operating to change the attitude of the movable portion from the fallen attitude to the erected attitude to thereby move the paper feeding roller from the containing position to the operating position.

3. The paper feeding apparatus according to claim 2, wherein at the containing position of the paper feeding roller, the paper feeding roller rides over the base portion.

4. The paper feeding apparatus according to claim 2, wherein the paper feeding roller unit is attached pivotally to the movable portion of the sheet base at a position concentric with a rotational center of the input ring member.

5. The paper feeding apparatus according to claim 4, wherein the movable portion is made to be erectable and fallable by providing an arm pivotally supported by the lateral shaft to the movable portion of the sheet base and the paper feeding roller unit is pivotally attached to the arm at an eccentric portion relative to an axis line of the lateral shaft.

6. The paper feeding apparatus according to claim 5, wherein the input ring member is rotatably supported by a shaft member provided to the paper feeding roller unit and the shaft member is extended in a side direction of the roller unit to be attached to the arm to thereby pivotally attach the paper feeding roller unit to the arm and the shaft member is displaced in an up and down direction around the lateral shaft along with an operation of erecting and falling the movable portion of the sheet base.

* * * * *